US006843673B1

(12) United States Patent
Liu et al.

(10) Patent No.: US 6,843,673 B1
(45) Date of Patent: Jan. 18, 2005

(54) COAXIAL CONNECTOR STRUCTURE

(75) Inventors: Lun Ting Liu, Kuishan Hsiang (TW); Ching Lung Liu, Kuishan Hsiang (TW); Shun Yung Chang, Kuishan Hsiang (TW)

(73) Assignee: Speed Tech Corp., Taoyuan (TW)

( * ) Notice: Subject to any disclaimer, the term of this patent is extended or adjusted under 35 U.S.C. 154(b) by 0 days.

(21) Appl. No.: 10/834,853

(22) Filed: Apr. 30, 2004

(51) Int. Cl.[7] ..... H01R 29/00
(52) U.S. Cl. ..... 439/188; 439/63; 439/944
(58) Field of Search ..... 439/188, 944, 439/851, 83, 578, 63; 200/51.1, 50.09

(56) References Cited

U.S. PATENT DOCUMENTS 6,296,492 B1 * 10/2001 Fujimoto et al. ..... 439/63
6,520,785 B2 * 2/2003 Hida ..... 439/188
6,554,630 B2 * 4/2003 Uratani ..... 439/188
6,585,532 B2 * 7/2003 Uratani et al. ..... 439/188
6,666,699 B2 * 12/2003 Uratani ..... 439/188
6,783,374 B2 * 8/2004 Uratani et al. ..... 439/83

* cited by examiner

*Primary Examiner*—Michael C. Zarroli
(74) *Attorney, Agent, or Firm*—Troxell Law Office PLLC

(57) ABSTRACT

A coaxial connector structure including an insulating member, a fixed metal terminal, a movable metal terminal and a conductive shade. The insulating member includes a bendable connecting section, an insulating seat and an insulating cover connected with the insulating seat via the connecting section. The insulating seat is formed with multiple insertion sockets. The fixed and movable metal terminals are formed with insertion plates which can be inserted and located in the insertion sockets. When assembled, the respective parts and internal elements of the insulating seat and insulating cover are easily accurately located so that the assembling procedure is simplified and the quality of the product is enhanced. The conductive shade is firmly located around the insulating member to cover the same so as to shield the product from electromagnetic wave and enhance the connecting strength.

16 Claims, 4 Drawing Sheets

COAXIAL CONNECTOR STRUCTURE

BACKGROUND OF THE INVENTION

The present invention is related to an improved coaxial connector structure, and more particularly to a superminiature coaxial connector which has a simple structure and a switching function and can be easily accurately assembled.

U.S. Pat. No. 6,585,532 discloses a superminiature coaxial connector with switching function. In this coaxial connector, by means of thermoplastic plastics, a fixed metal contact and a movable metal contact are riveted on a lower insulating body. The fixed metal contact and movable metal contact resiliently contact with each other. An upper insulating body having a boss is overlaid on the lower insulating body. A housing holds the upper and lower insulating bodies to form an integral body.

The above structure has some shortcomings as follows:

1. The fixed metal contact and movable metal contact are fixed in such a manner that the lower insulating body is heated and softened to deform a predetermined portion so as to hold and locate the fixed metal contact and movable metal contact. Such procedure is quite inconvenient. In addition, in processing, it is hard to accurately control the fixed positions of the metal contacts. Therefore, the quality of the product will be affected.
2. The upper and lower insulating bodies are independent and separated bodies. Therefore, when assembled, it is necessary to align the upper insulating body with the lower insulating body and then associate the two bodies. This leads to inconvenience in assembly and affects processing efficiency.

U.S. Patent Application Publication No. US2003/007793A1 discloses a coaxial connector having an integrally molded insulating seat. The insulating seat is formed with a tubular receiving space transversely passing through the insulating seat. An upward extending through hole communicates with the middle section of the receiving space. A movable terminal and a fixed terminal are inlaid in the receiving space. The movable terminal resiliently contacts with the fixed terminal.

The above structure has some shortcomings as follows:

1. The integrally molded insulating seat is formed with T-shaped receiving space. The mold for molding such structure is relatively complicated and higher injection molding technique is required. Also, the molding time is prolonged. Accordingly, the development and production cost is increased.
2. The movable terminal and fixed terminal are inlaid in the receiving space at different heights. It is quite inconvenient to assemble the movable terminal and fixed terminal. Therefore, the assembling efficiency is low and the accuracy of the product is poor.

Taiwanese Patent Publication No. 523202 (Application No. 90219027) discloses a coaxial microwave switch connector. Such connector includes two independently separated insulating bodies and a bottom board for clamping two oppositely extending resilient plates and a grounding plate. A housing is fitted around the insulating bodies and the bottom board to associate the same. It is troublesome to assemble the insulating bodies and the bottom board.

SUMMARY OF THE INVENTION

It is therefore a primary object of the present invention to provide a coaxial connector structure including an insulating member, a fixed metal terminal, a movable metal terminal and a conductive shade. The insulating member includes a bendable connecting section, an insulating seat and an insulating cover foldably connected with the insulating seat via the connecting section. The fixed and movable metal terminals can be easily accurately assembled with the insulating seat. When the insulating cover is closed onto the insulating seat, the fixed and movable metal terminals are firmly located so that the assembling procedure is simplified and the quality of the product is enhanced. The conductive shade is firmly located around the insulating member to cover the same so as to enhance the connecting strength.

It is a further object of the present invention to provide the above coaxial connector structure in which the fixed and movable metal terminals are formed with insertion plates which can be tightly inserted and located in the insertion sockets of the insulating seat. Therefore, the movable and fixed metal terminals can be easily accurately located to enhance the assembling efficiency and electric contact accuracy.

The present invention can be best understood through the following description and accompanying drawings wherein:

DETAILED DESCRIPTION OF THE PREFERRED EMBODIMENTS

Figure 1:
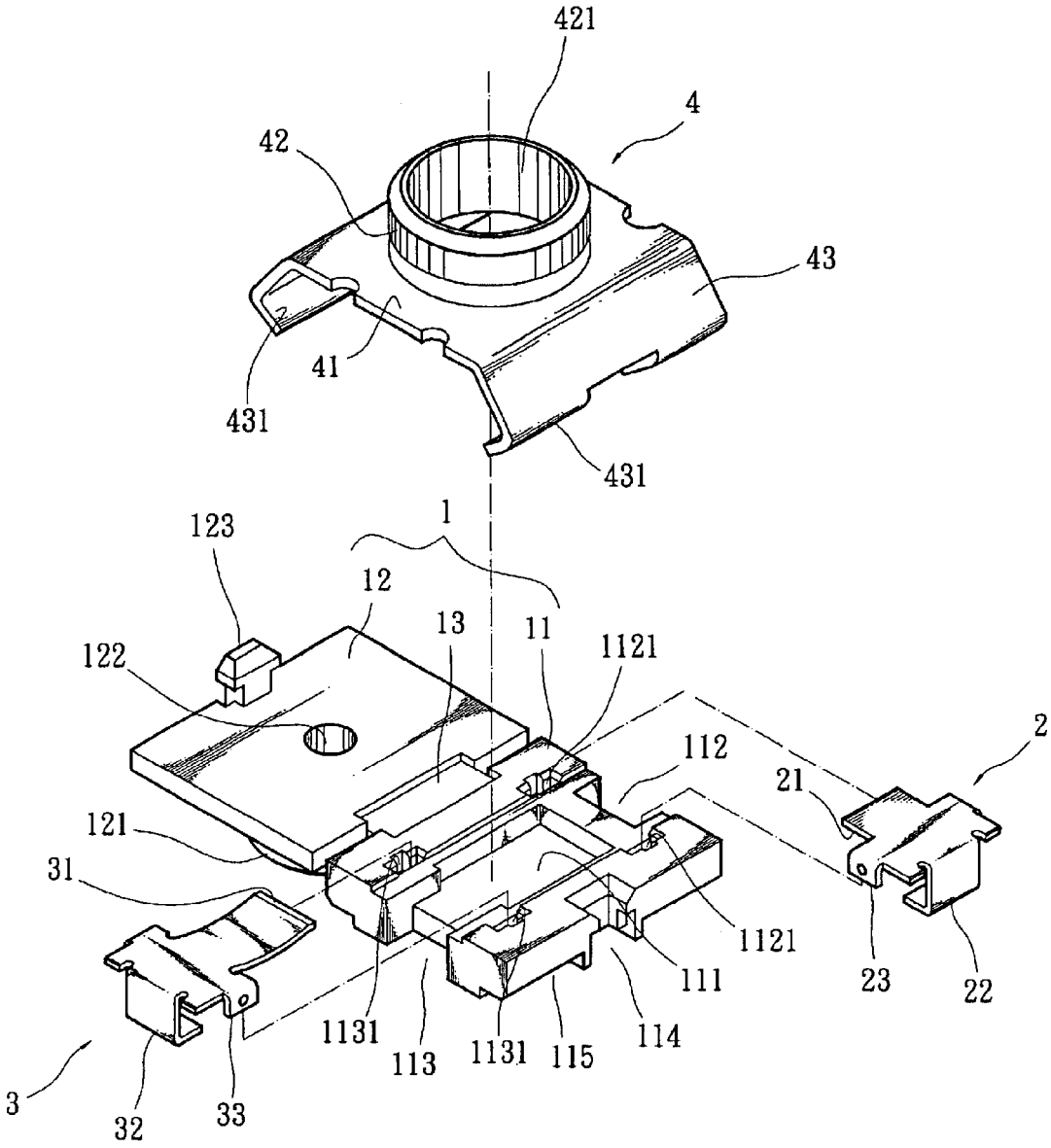
FIG. 1 is a perspective exploded view of the present invention.

Please refer to FIG. 1. The present invention includes an insulating member 1, fixed metal terminal 2, movable metal terminal 3 and a conductive shade 4. The insulating member 1 includes a bendable connecting section 13, an insulating seat 11 and an insulating cover 12 integrally connected with the insulating seat 11 via the connecting section 13. The periphery of the insulating seat 11 is formed with a downward extending first recess 112 and a downward extending second recess 113. The top face of the insulating seat 11 is preformed with a receptacle 111. In addition, at least one set of symmetrical first insertion sockets 1121 are respectively formed on two sides of the first recess 112. At least one set of symmetrical second insertion sockets 1131 are respectively formed on two sides of the second recess 113. One side of the insulating seat 11 is formed with an engaging mortise 114. The periphery of bottom face of the insulating seat 11 is formed with multiple dents 115. A boss 121 is formed at the center of outer face of the insulating cover 12. The boss 121 is formed with a central through hole 122. The insulating cover 12 is further formed with an engaging tenon 123 corresponding to the engaging mortise 114 of the insulating seat 11. One end of the fixed metal terminal 2 is formed with a contact section 21. The other end of the fixed metal terminal 2 is formed with a substantially C-shaped downward bent section. A lower end of the bent section is formed with a soldering face 22. Two downward bent insertion plates 23 are respectively formed on two sides of the fixed metal terminal 2 between the contact section 21 and the bent section. One end of the movable metal terminal 3 is formed with a resilient contact section 31 with an upward curved free end. The other end of the movable metal terminal 3 is formed with a downward bent section and soldering face 32 similar to those of the fixed metal terminal 2. Two downward bent insertion plates 33 are respectively formed on two sides of the movable metal terminal 3 between the resilient contact section 31 and the bent section. The conductive shade 4 has a shape corresponding the shape of the folded insulating member 1. The conductive shade 4 has a plane section 41. A neck boss 42 is disposed at the center of the plane section 41 corresponding to the boss 121 of the insulating cover 12. The neck boss 42 is formed with a central through hole 421 in which the boss 121 is snugly fitted. At least one side of the plane section 41 is formed with a bent edge 43. The free end of the bent edge 43 has a hook section 431.

Figure 2:
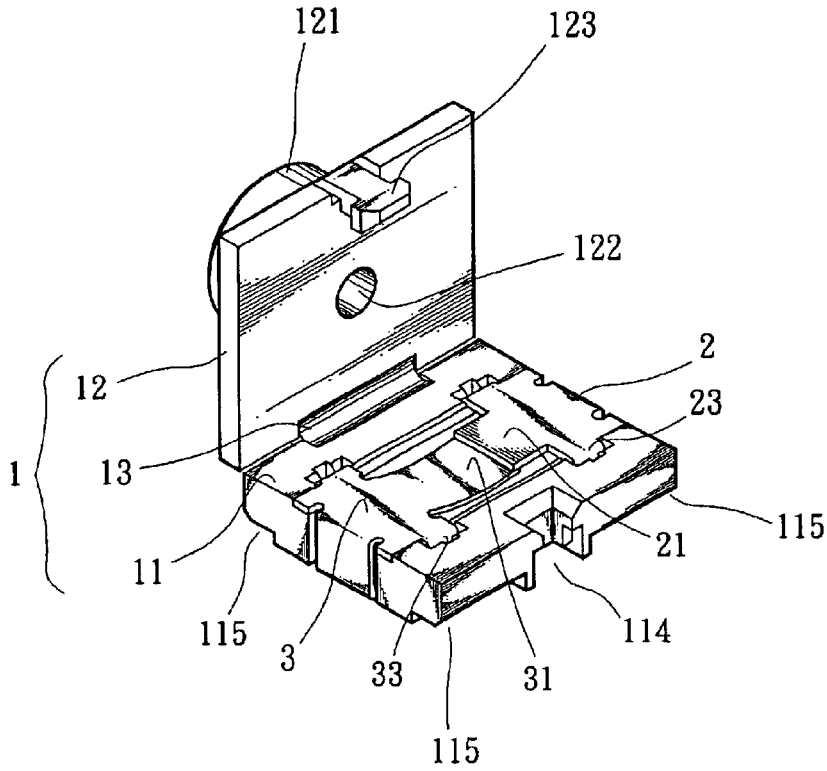
FIG. 2 is a perspective assembled view of a part of the present invention in an unfolded state.
Figure 3:
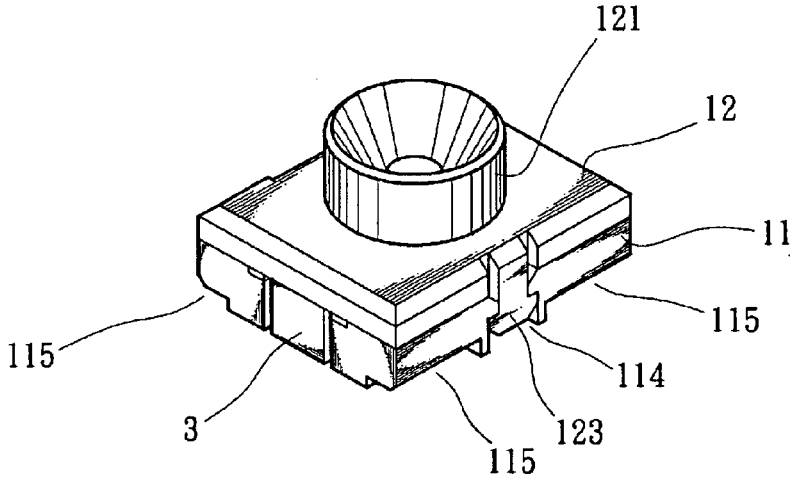
FIG. 3 is a perspective assembled view of a part of the present invention in a folded state.
Figure 4:
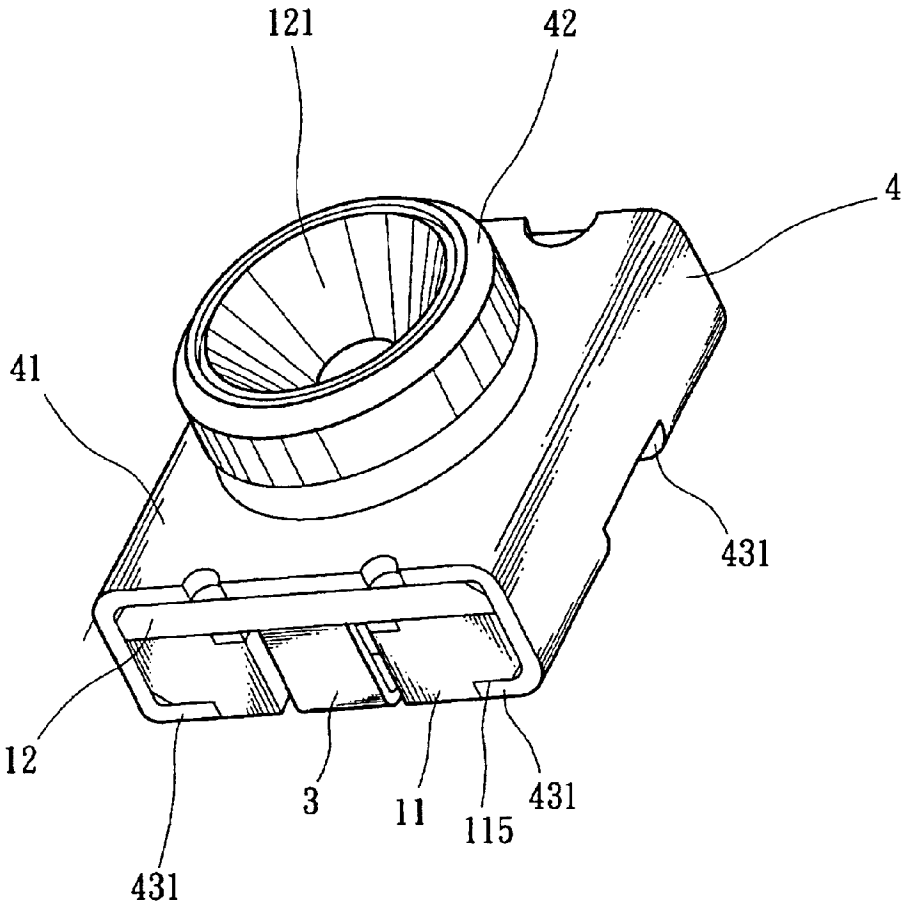
FIG. 4 is a perspective assembled view of the present invention.
Figure 5:
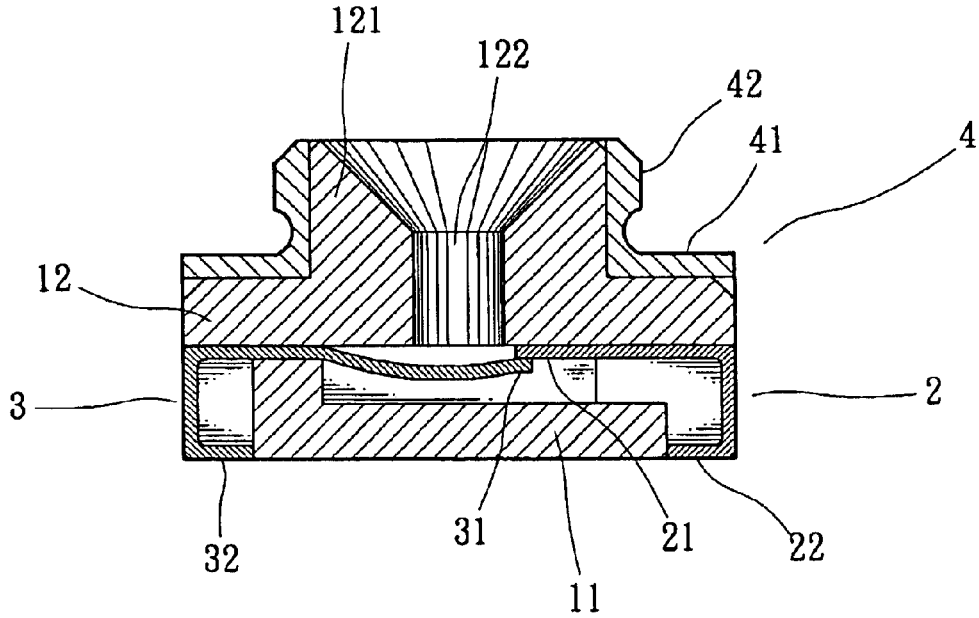
FIG. 5 is a sectional assembled view of the present invention.

FIGS. 2 and 3 are perspective assembled views of the insulating member 1 and the two metal terminals 2, 3 of the present invention. FIGS. 4 and 5 respectively are perspective assembled view and sectional assembled view of the present invention. When assembled, the insertion plates 33 of the movable metal terminal 3 are tightly inserted and located in the second insertion sockets 1131 of the insulating seat 11. The resilient contact section 31 extends into the receptacle 111 and gets close to a position where the fixed metal terminal 2 is mounted. The soldering face 32 downward extends through the second recess 113 to bottom side of the insulating seat 11 to clamp the insulating seat 11. Then the insertion plates 23 of the fixed metal terminal 2 are inserted and located in the first insertion sockets 1121 of the insulating seat 11. The contact section 21 extends to upper side of the receptacle 111 to contact with the resilient contact section 31 of the movable metal terminal 3 in normal state. The soldering face 22 downward extends through the first recess 112 to bottom side of the insulating seat 11 to clamp the insulating seat 11 (as shown in FIG. 2) for soldering with an external signal source. Then, by means of bending the connecting section 13, the insulating cover 12 is closed onto the insulating seat 11 to cover the same. The engaging tenon 123 is inserted into the engaging mortise 114 and latched therein (as shown in FIG. 3). Then the conductive shade 4 is fitted around the insulating member 1 with the boss 121 of the insulating cover 12 accommodated in the through hole 421 of the neck boss 42. Also, the hook sections 431 of the bent edges 43 are inserted into the dents 115 of the insulating seat 11. Therefore, the conductive shade 4 can be firmly located around the insulating member 1 to cover the same (as shown in FIGS. 4 and 5).

The insulating seat 11 and the insulating cover 12 are integrally connected via the bendable connecting section 13. When assembled, the respective parts and the internal elements (metal terminals 2, 3) of the insulating seat 11 and insulating cover 12 are naturally accurately located. It is only necessary to directly turn the insulating cover 12 onto the insulating seat 11 and insert the engaging tenon 123 into the engaging mortise 114 of the insulating seat 11 so as to accurately correspondingly associate the insulating seat 11 and insulating cover 12. By means of the insertion plates 23, 33, the fixed metal terminal 2 and the movable metal terminal 3 can be easily accurately inserted in the first and second insertion sockets 1121, 1131 of the insulating seat 11. The insulating cover 12 further presses the fixed metal terminal 2 and the movable metal terminal 3 to truly locate the same. In contrast to conventional structure, the assembling procedure is simplified and the ratio of good products is enhanced.

Figure 6:
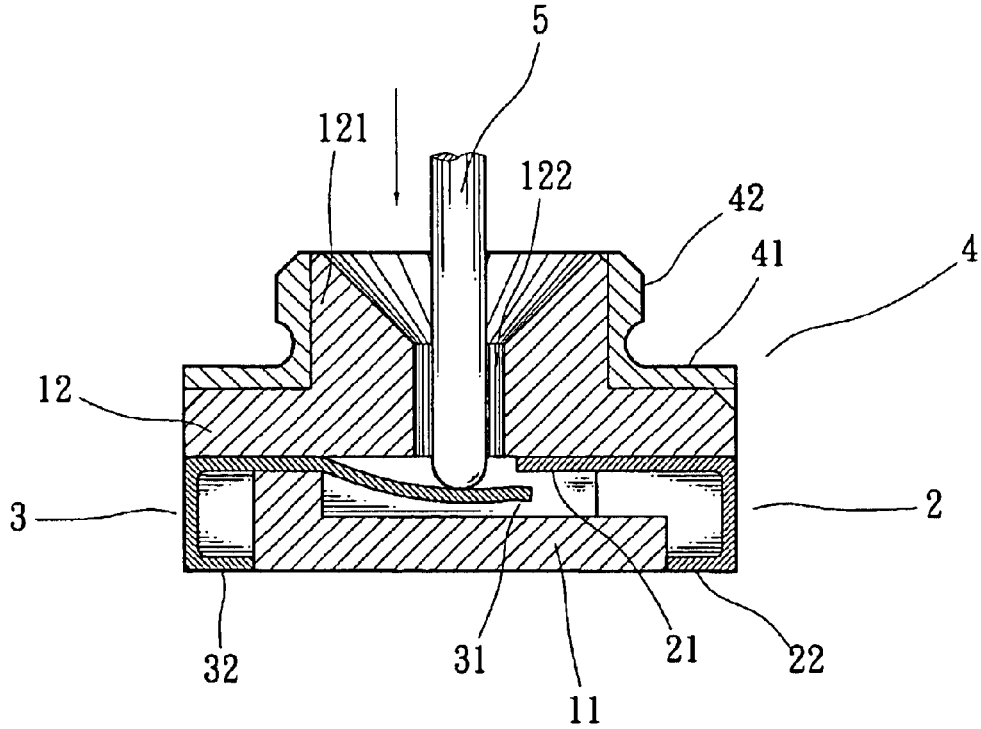
FIG. 6 is a view according to FIG. 6, showing that a plug is inserted in the present invention to disconnect the movable metal terminal from the fixed metal terminal of the present invention.

FIG. 6 shows that after an insertion terminal 5 is inserted into the present invention, the movable metal terminal 3 is separated from the fixed metal terminal 2. Referring to FIGS. 5 and 6, in natural state, the resilient contact section 31 of the movable metal terminal 3 electrically contacts with the contact section 21 of the fixed metal terminal 2. When a plug is fitted into the boss 42 of the conductive shade 4, a post-like insertion terminal 5 extends through the through hole 122 of the insulating cover 12 into the receptacle 111 of the insulating seat 11 to abut against the resilient contact section 31 of the movable metal terminal 3. At this time, the resilient contact section 31 is lowered and separated from the contact section 21 of the fixed metal terminal 2. Accordingly, the fixed metal terminal 2 is disconnected from the movable metal terminal 3, while the movable metal terminal 3 is electrically connected with the inserted terminal 5 to achieve a According to the above arrangement, the coaxial connector of the present invention can be easily, conveniently and quickly assembled. In addition, the elements of the coaxial connector can be accurately located and firmly connected.

The above embodiments are only used to illustrate the present invention, not intended to limit the scope thereof. Many modifications of the above embodiments can be made without departing from the spirit of the present invention.

What is claimed is:

1. A coaxial connector structure comprising:

an insulating member including a bendable connecting section, an insulating seat and an insulating cover integrally foldably connected with the insulating seat via the connecting section, the insulating cover being closed onto the insulating seat, a face of the insulating seat on which the insulating cover is closed being formed with a receptacle, a boss being formed at the center of outer face of the insulating cover, the boss being formed with a central through hole;

a movable metal terminal located in the receptacle of the insulating seat, one end of the movable metal terminal being formed with a resilient contact section, the other end of the movable metal terminal being formed with a downward bent section for clamping an edge of the insulating seat, a lower end of the bent section being formed with a soldering face;

a fixed metal terminal located on the other side of the insulating seat, one end of the fixed metal terminal being formed with a contact section extending to upper side of the resilient contact section of the movable metal terminal, whereby in normal state, the contact section of the fixed metal terminal contacts with the resilient contact section of the movable metal terminal, the other end of the fixed metal terminal being formed with a downward bent section for clamping an edge of the insulating seat, a lower end of the bent section being formed with a soldering face; and a conductive shade having a shape corresponding to the shape of the folded insulating member, a neck boss being disposed on the conductive shade corresponding to the boss of the insulating cover, the neck boss being formed with a through hole in which the boss of the insulating cover is snugly fitted, at least one side of the conductive shade being formed with a bent edge, a free end of the bent edge having a hook section, whereby the metal terminals are previously assembled with the insulating seat and then by means of bending the connecting section, the insulating cover is turned and closed onto the insulating seat to cover the same, then the conductive shade being fitted around the insulating member with the hook sections of the bent edges hooking bottom face of the insulating seat, whereby the conductive shade firmly clamps and covers the insulating member.

2. The coaxial connector structure as claimed in claim 1, wherein at least one pair of insertion sockets are formed on the face of the insulating seat on which the insulating cover is closed, each of the fixed and movable metal terminals being formed with insertion plates corresponding to the insertion sockets, whereby the insertion plates can be directly tightly inserted and located in the insertion sockets.

3. The coaxial connector structure as claimed in claim 1, wherein one side of the insulating seat is formed with an engaging mortise and one side of the insulating cover is formed with an engaging tenon, whereby when the insulating cover is clo sed onto the insulating seat, the engaging tenon is inserted into the engaging mortise to firmly associate the insulating cover with the insulating seat.

4. The coaxial connector structure as claimed in claim 2, wherein one side of the insulating seat is formed with an engaging mortise and one side of the insulating cover is formed with an engaging tenon, whereby when the insulating cover is closed onto the insulating seat, the engaging tenon is inserted into the engaging mortise to firmly associate the insulating cover with the insulating seat.

5. The coaxial connector structure as claimed in claim 1, wherein a periphery of the insulating seat is formed with recesses corresponding to the bent sections of the two metal terminals, whereby the bent sections of the metal terminals can be inserted in the recesses.

6. The coaxial connector structure as claimed in claim 2, wherein a periphery of the insulating seat is formed with recesses corresponding to the bent sections of the two metal terminals, whereby the bent sections of the metal terminals can be inserted in the recesses.

7. The coaxial connector structure as claimed in claim 3, wherein a periphery of the insulating seat is formed with recesses corresponding to the bent sections of the two metal terminals, whereby the bent sections of the metal terminals can be inserted in the recesses.

8. The coaxial connector structure as claimed in claim 4, wherein a periphery of the insulating seat is formed with recesses corresponding to the bent sections of the two metal terminals, whereby the bent sections of the metal terminals can be inserted in the recesses.

9. The coaxial connector structure as claimed in claim 1, wherein a periphery of bottom face of the insulating seat is formed with multiple dents, whereby the hook sections of the conductive shade can be inserted and located in the dents.

10. The coaxial connector structure as claimed in claim 2, wherein a periphery of bottom face of the insulating seat is formed with multiple dents, whereby the hook sections of the conductive shade can be inserted and located in the dents.

11. The coaxial connector structure as claimed in claim 3, wherein a periphery of bottom face of the insulating seat is formed with multiple dents, whereby the hook sections of the conductive shade can be inserted and located in the dents.

12. The coaxial connector structure as claimed in claim 4, wherein a periphery of bottom face of the insulating seat is formed with multiple dents, whereby the hook sections of the conductive shade can be inserted and located in the dents.

13. The coaxial connector structure as claimed in claim 5, wherein a periphery of bottom face of the insulating seat is formed with multiple dents, whereby the hook sections of the conductive shade can be inserted and located in the dents.

14. The coaxial connector structure as claimed in claim 6, wherein a periphery of bottom face of the insulating seat is formed with multiple dents, whereby the hook sections of the conductive shade can be inserted and located in the dents.

15. The coaxial connector structure as claimed in claim 7, wherein a periphery of bottom face of the insulating seat is formed with multiple dents, whereby the hook sections of the conductive shade can be inserted and located in the dents.

16. The coaxial connector structure as claimed in claim 8, wherein a periphery of bottom face of the insulating seat is formed with multiple dents, whereby the hook sections of the conductive shade can be inserted and located in the dents.

* * * * *